United States Patent [19]

Hopper

[11] Patent Number: 4,971,572

[45] Date of Patent: Nov. 20, 1990

[54] ELECTRICAL CONNECTOR

[75] Inventor: Scott R. Hopper, Redmond, Wash.

[73] Assignee: Telzon, Inc., Seattle, Wash.

[21] Appl. No.: 378,971

[22] Filed: Jul. 12, 1989

[51] Int. Cl.[5] ..... H01R 4/24

[52] U.S. Cl. ..... 439/407; 439/399; 439/460

[58] Field of Search ..... 439/389–419, 439/452, 676, 344, 460

[56] References Cited

U.S. PATENT DOCUMENTS

| | | | |
|---|---|---|---|
| 4,286,835 | 9/1981 | Adams et al. | 439/395 |
| 4,545,635 | 10/1985 | Bunnell | 439/404 |
| 4,555,158 | 11/1985 | Lam | 439/404 |
| 4,606,595 | 8/1986 | Dola | 439/404 |
| 4,679,881 | 7/1987 | Galvin et al. | 439/392 |
| 4,759,726 | 7/1988 | Naylor et al. | 439/441 |
| 4,790,769 | 12/1988 | Kanada | 439/676 |

FOREIGN PATENT DOCUMENTS

| | | | |
|---|---|---|---|
| WO87/01518 | 3/1987 | PCT Int'l Appl. | 439/399 |

*Primary Examiner*—David L. Pirlot

*Attorney, Agent, or Firm*—Weingarten, Schurgin, Gagnebin & Hayes

[57] ABSTRACT

A screwless connector is provided for electrically connecting an RJ type connector with two or more insulated conductors. An exemplary embodiment of the invention includes a base having spaced grooves with pronged retainers straddling the grooves at each end for holding, indexing, and providing strain relief to conductors. It also includes a top assembly which contains fork-shaped insulation displacement contacts (IDC) in electrical communication with an integrally housed receptacle for an RJ type connector. The top assembly is mated to the bottom assembly and held by detents. The insulation is thereby pierced by grooves of the insulation displacement contacts which are prepositioned in the top assembly, and electrical interconnection is established between the conductors and an RJ type connector placed in the receptacle.

8 Claims, 3 Drawing Sheets

ELECTRICAL CONNECTOR

FIELD OF THE INVENTION

This invention relates to electrical connectors, and more particularly to an electrical connector which provides interconnection between two or more insulated conductors and an RJ-type connector.

BACKGROUND OF THE INVENTION

An electrical interconnection between RJ-type connectors and insulated conductors is frequently required. RJ type connectors such as modular jacks are widely used, for example, to interface telephones, computers, answering machines, and other systems, components, and units. However, the usual method of electrically interconnecting those systems, components, and units to others which do not employ RJ-type connectors involves manual labor, time, and dexterity.

The usual method involves stripping a portion of the wires and screwing individual exposed leads to a wall jack. Each of the leads must be stripped to a critical length allowing for electrical interconnection between a chosen screw terminal and avoiding contact with other exposed leads and screw terminals in topological proximity on the jack. The insulation must be stripped without destroying the integrity of the underlying conductor. Then the conductor must be wound around the screw which subsequently must be tightened by a screwdriver. The act of tightening the screw sufficiently to retain the wire introduces stress and entails the risk of over-tightening and squeezing the wire from under the screw head. This is an added frustration in circumstances in which screw terminals must be disconnected and reconnected to locate and isolate fault sources.

The screw-retaining method is especially inadequate where electrical interconnection to an RJ-type connector is desired along the electrical path, rather than at the end, of a telephone line. Cutting the wire entails twice the number of wire leads which must be reconnected to reestablish the electrical path. Telephone service, in such a case, would be interrupted.

Techniques are known and used for permitting electrical interconnection between insulated conductors and other electrical components or units. Exemplary electrical interconnection devices are disclosed in U.S. Pat. Nos. 4,679,881 and 4,759,726. An electrical terminal block device which is screwless is illustrated in U.S. Pat. No. 4,759,726. However, this particular device requires that insulated conductors be cut and stripped prior to termination with a retaining means. On the other hand, a device using an insulation displacement connector for piercing the insulation and providing a series electrical connection between a singular conductor and an electrical component is illustrated in U.S. Pat. No. 4,679,881. This device, however, requires that an insulated conductor be looped and pulled across a knife blade to expose said conductor to two electrical contacts. Neither of the aforementioned connection devices provides for quick or convenient electrical interconnection between at least two conductors and an RJ-type connector.

In view of the foregoing difficulties and limitations, a simple and inexpensive device is needed for providing a screwless, quick, easy, orderly, and terminal/continuous interconnection between at least two insulated conductors and an RJ-type connector.

SUMMARY OF THE INVENTION

In surmounting the difficulties and limitations mentioned above, the present invention provides a connector device for providing a screwless, easy, quick, orderly, and terminal/continuous electrical interconnection between an RJ-type connector and two or more conductors. In an exemplary embodiment of the invention, an electrical interconnection is achieved by placing a conductor into a coded channel in the base, which has pronged retainers, then mating it to the top assembly containing the prepositioned insulation displacement contact means. The top assembly is removably mated to the base by means of detents. The fork-shaped insulation displacement contact means includes grooves for piercing the insulation and communicating electrically with the conductor. An RJ-type connector may be placed into a receptacle which is integral to the top assembly and which communicates electrically, by means of a coupling member, to the insulation displacement contact means. The exemplary embodiment of the invention also includes a polarization pin for correct alignment of the top assembly with respect to the base, so that a conductor placed in a coded channel may communicate electrically with a respective, predetermined contact of an RJ-type connector placed into a receptacle in the top assembly.

In addition to ease and orderliness of connection, the present invention may be installed and operative in one or two minutes in contrast to the fifteen to twenty minutes required for currently used modular jacks. The present invention, moreover, provides a means for quick disconnection and reconnection when fault sources need to be located and isolated within a system of components. The invention may also be installed without interrupting service, an obvious advantage in telephone systems, and it may serve as a demarcation point between the lines provided by the telephone company and the apparatus provided by the customer.

A further advantage of the present invention is simplicity of topology which affords efficiency in manufacture, assembly, and use. Conductors are retained in close proximity on the base with little or no risk of short circuits due to chance electrical contact between stripped conductor leads. The insulation displacement contact means, which includes the piercing groove connected by a coupling member to a contact for an RJ-type connector, can be stamped from one piece of metal. The presently preferred embodiment of the invention allows for the inexpensive molding of a connector of small size. Therefore, the advantages of the present invention allow for ease in manufacture as well as ease in application and use.

DESCRIPTION OF THE DRAWINGS

In illustrating the invention to facilitate its understanding through the ensuing detailed descriptions, the drawings show a form which is presently preferred. The invention is not limited, however, to the instrumentalities and arrangements particularly shown.

DETAILED DESCRIPTION OF THE INVENTION

Figure 1:
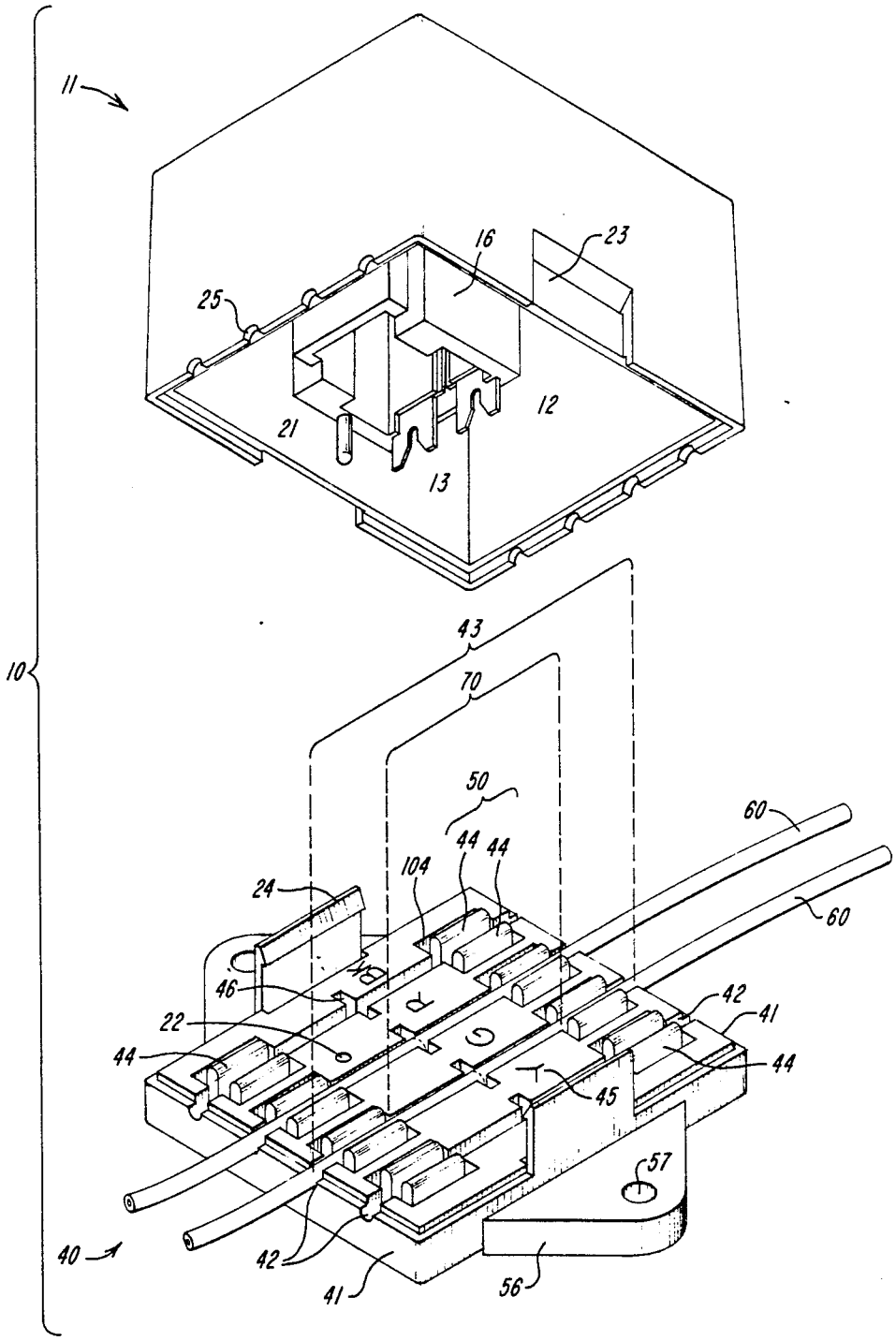
FIG. 1 is an exploded perspective view of a connector according to the present invention.

As referenced in the appended drawings, an exemplary embodiment of the IDC connector 10 contains a base 40 and top assembly 11. Insulated conductors 60 may be placed in the pronged retainers 44 of the base 40 according to a coding means 41 such as a letter, color, or symbol impressed on the base 40 for indexing each conductor 60. A top assembly 11 containing fork-shaped insulation displacement contacts 12 with piercing and contact grooves 13 is then mated to the base 40. The insulation displacement contact 12, which is permanently prepositioned in the top assembly 11, pierces the insulation of the conductor 60 and thereby establishes electrical communication with it. The prepositioned insulation displacement contact 12 is electrically coupled to an RJ-type contact 15 located in the RJ-type receptacle 16 integrally housed in the top assembly 11. Hence, an RJ-type connector 17 placed in the RJ-type receptacle 16 is electrically interconnected to conductors 60 automatically. To ensure that a conductor 60 placed in a retainer 44 is correctly connected to a predetermined contact 15 on the RJ-type connector 17, the top assembly 11 includes a polarization pin 21 corresponding to a polarization hole 22 located in the base 40 for aligning the top assembly 11 to the base 40. Finally, the top assembly 11 has outward detents 23 complementary to inward detents 24 on the base 40 for fastening the top assembly 11 to the base 40. Once mated, the top assembly 11 may be quickly removed by gripping it near the detents, and disengaging the top assembly 11 from the base 40.

Figure 3:
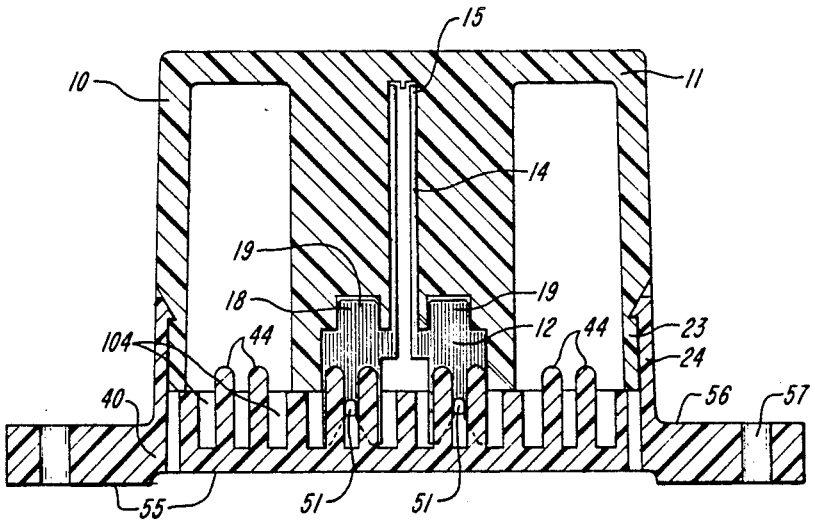
FIG. 3. is a cross-sectional view of the connector of FIG. 2 taken along line 3—3 thereof.
Figure 4:
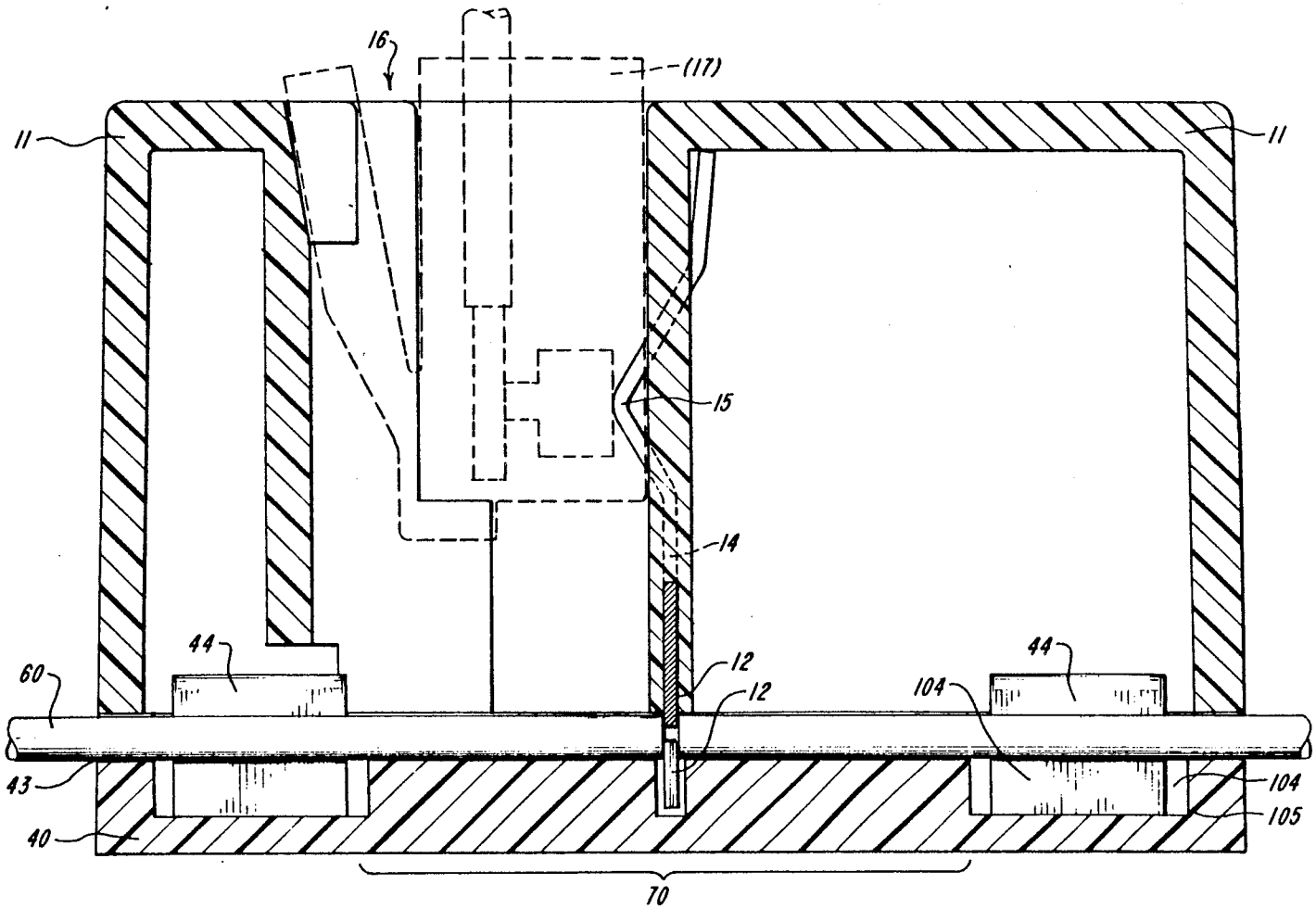
FIG. 4. is a cross-sectional view of the connector of FIG. 2 taken along line 4—4 thereof.

Ease of manufacture and application of the connector 10 are facilitated by the insulation displacement contacts 12, which include piercing and contact grooves 13 which are electrically communicative with an RJ-type contact 15 by means of a coupling member 14 configured from a continuous piece of metal. FIG. 3. shows an insulation displacement contact 12 formed from a continuous piece of metal. In addition, the insulation displacement contact 12 has a seating member 18 complementary to a seating receptacle 19 integrally fixed in the top assembly 11 for permanently holding and prepositioning the insulation displacement contact 12 and maintaining electrical separation from other insulation displacement contacts 12. The seating member 18, as shown in FIG. 3, may also be configured from the same continuous piece of metal. Finally, the RJ-type contact 15, as shown in FIG. 4, may be configured by bending the continuous piece of metal partially into the RJ-type receptacle 16. Thus, the insulation displacement contact 12 provides for a short and direct electrical path between a pierced insulated conductor 60 and an RJ-type connector 17. The configuration of the insulation displacement contact 12 allows close proximity between the RJ-type connector 17 and conductor 60 disposed in the base 40, so that the integral receptacle 16 for housing the RJ-type connector 17 may be easily configured to provide structural integrity to the connector 10 when the top assembly 11 is mounted to the base 40. See FIG. 4.

Figure 2:
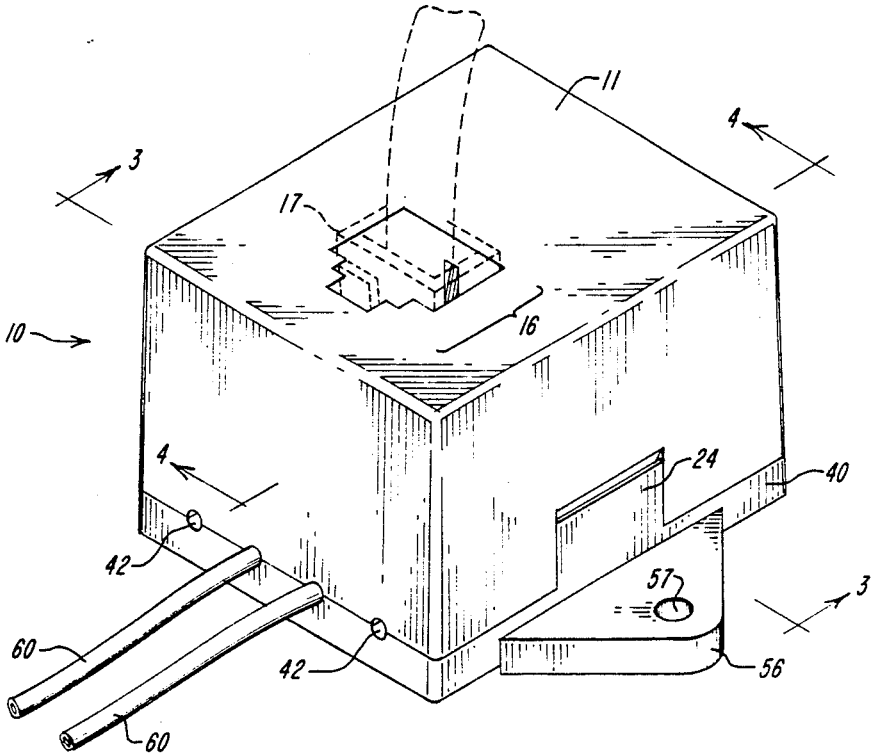
FIG. 2 is a perspective view of the connector of FIG. 1. in a mated configuration.

The base 40 as shown in FIG. 1 contains opposing sides 41 each having two or more openings 42 corresponding to each of the openings 42 on the other side 42. Each of the openings 42 defines a groove 43 which is spaced apart from other defined grooves and generally continuous from one side 42 to the other for permitting the placement of a conductor 60 in a retainer 44 which holds and provides strain relief to the conductor 60. The openings 42 in the base 40 are complementary to openings 25 in the top assembly 11 and provide a further means of holding conductors 60, as illustrated in FIG. 2. The base 40 may be molded with grooves 43 having a cross-sectional size conforming to the size of conductors 60 in order to provide further means of holding and providing strain relief to the conductors 60 and facilitating the operation whereby the insulation is pierced by the insulation displacement contacts 12. Coding such as letters 45 may be placed adjacent to the spaced grooves 43 to provide indexing to conductors 60. The retainers located near the ends of each groove 43 are comprised of a set of prongs 50 which straddle the groove and define a clamp area 51 in alignment with the groove 43 and with a prepositioned fork-shaped insulation displacement contact 12 seated in the top assembly 11. The pronged retainers 44 define a strain-relief zone 70 within which a conductor 60 is held in at least three directions. The pronged retainer 44 can be made of resilient material for pliably receiving a conductor 60 and preventing slippage in three directions: along the length of the conductor 60, away from the base 40, and towards another conductor 60 disposed in the next channel 43. The pronged retainers 44 are shown mounted in a well 104 (See FIGS. 1, 3, and 4) having a floor 105 (FIG. 4) upon which the retainers 44 are secured to the base 40. The well floor level 105 may be lower than the groove level to permit prongs 44 to pliably retain a conductor held at groove level. The base 40 has a flat surface 55 for removably mounting the connector 10 onto another surface, or may include mounting tabs 56 having screw holes 57 for the same purpose. A piece of tape may be placed over the detents 40 and screw hole 57 to prevent tampering.

The invention is not limited by what has been particularly shown and described, except as indicated by the following appended claims.

What is claimed is:

1. A connector for providing electrical interconnection between an RJ-type connector and loose insulated conductors, comprising:

a base for holding and providing strain relief for loose insulated conductors, said base having:

at least two opposing sides;

at least two grooves extending between and through said opposing sides and sufficiently spaced apart to allow fork-shaped insulation displacement contacts to be used for transversely piercing insulated conductors placed in said grooves;

a retainer located near each end of each said groove adjacent said opposing sides, each said retainer having at least two prongs straddling said groove and defining a clamp area in alignment with said groove for releasably holding an insulated conductor placed therein;

a strain-relief zone defined within each said groove by and between said pronged retainers located near opposing ends of each said groove adjacent said opposing sides; and a slot transversely intersecting each said groove within said strain-relief zone, each said slot configured for removably and slidably receiving a fork-shaped insulation displacement contact;

a top assembly configured for mating with said base, said top assembly having:

a first fork-shaped insulation displacement contact prepositioned for slidably and removable insertion into said slots in said base, said contact having a cutting edge for transversely piercing the insulation of a loose insulated conductor placed in a said groove of said base to provide electrical interconnection therewith;

a second fork-shaped insulation displacement contact prepositioned for slidable and removable insertion into another of said slots in said base, said contact having a cutting edge for transversely piercing the insulation of another insulated conductor placed in another of said grooves to provide electrical interconnection therewith;

an RJ-type receptacle electrically interconnected to said prepositioned first and second insulation displacement contacts; and means for aligning said top assembly to mate with said base whereby said prepositioned insulation displacement contacts pierce the insulation of insulated conductors placed in said grooves to establish electrical communication between the pierced conductors and an RJ-type connector placed in said RJ-type receptacle.

2. The connector of claim 1 wherein said base further includes code indicia located adjacent said grooves for indexing the loose insulated conductors placed in said grooves.

3. The connector of claim 1 wherein said base includes detents, and wherein said top assembly includes complementary detents, wherein said detents in combination with said complementary detents removably mates said base and said top assembly in combination.

4. The connector of claim 1 wherein said base includes two sides, through which said grooves do not extend, having tabs coextensive with said flat member and containing screw holes for removably mounting said base against a flat surface.

5. The connector of claim 1 wherein said top assembly includes a polarization pin and wherein said base includes a corresponding polarization hole, said polarization pin and complementary polarization hole in combination comprising said aligning means.

6. The connector of claim 1 further comprising a housing in said top assembly for securing said RJ-type receptacle, prepositioning said first and second insulation displacement contacts, and for preventing bending and misalignment of said first and second insulation displacement contacts.

7. The connector of claim 1 wherein said base further includes a well surrounding each of said pronged retainers, each well having a floor for securing said pronged retainer to said base, the level of each said well floor being below the level of said grooves to permit said pronged retainers to move pliably where said clamp area defined by said pronged retainer is in alignment with said grooves.

8. A connector for providing electrical interconnection between an RJ-type connector and loose insulated conductors, comprising:

a base for holding and providing strain relief for loose insulated conductors, said base having:

at least two opposing sides, at least two grooves extending between and through said opposing sides and sufficiently spaced apart to allow fork-shaped insulation displacement contacts to be used for transversely piercing insulated conductors placed in said grooves;

a pair of pronged retainers straddling each of said at least two grooves, each of said pair sufficiently spaced apart from the other of said pair to allow transverse piercing of an insulated conductor placed therebetween, each of said pair further defining between its prongs a clamp area in alignment with said groove for releasably holding an insulated conductor placed therein;

a strain-relief zone defined within each said groove by and between said paired retainers; and a slot transversely intersecting each said groove within said strain-relief zone, each said slot configured for removably and slidably receiving a fork-shaped insulation displacement contact;

a top assembly configured for mating with said base, said top assembly having:

a first fork-shaped insulation displacement contact prepositioned for slidably and removable insertion into said slots in said base, said contact having a cutting edge for transversely piercing the insulation of a loose insulated conductor placed in a said groove of said base to provide electrical interconnection therewith;

a second fork-shaped insulation displacement contact prepositioned for slidably and removable insertion into another of said slots in said base, said contact having a cutting edge for transversely piercing the insulation of another insulated conductor placed in another of said grooves to provide electrical interconnection therewith;

an RJ-type receptacle electrically interconnected to said prepositioned first and second insulation displacement contacts; and means for aligning said top assembly to mate with said base whereby said prepositioned insulation displacement contacts pierce the insulation of insulated conductors placed in said grooves to establish electrical communication between the pierced conductors and an RJ-type connector placed in said RJ-type receptacle.

* * * * *